US005607040A

United States Patent [19]

Mathurin, Sr.

[11] Patent Number: 5,607,040

[45] Date of Patent: Mar. 4, 1997

[54] CURRENCY COUNTER-FEIT DETECTION DEVICE

[76] Inventor: Trevor S. Ives Mathurin, Sr., 865 Planders Ave., Uniondale, N.Y. 11553

[21] Appl. No.: 584,073

[22] Filed: Jan. 11, 1996

Related U.S. Application Data

[63] Continuation of Ser. No. 218,247, Mar. 28, 1994, abandoned.

[51] Int. Cl.[6] ..... G07D 7/00

[52] U.S. Cl. ..... 194/207; 356/71

[58] Field of Search ..... 194/207; 209/534; 356/71

[56] References Cited

U.S. PATENT DOCUMENTS

| | | | |
|---|---|---|---|
| 2,950,799 | 8/1960 | Timms | 194/207 |
| 3,122,227 | 2/1964 | Bookout et al. | 194/207 |
| 3,256,968 | 6/1966 | Riddle et al. | 194/207 |
| 3,340,978 | 9/1967 | Haville | 194/207 |
| 4,253,016 | 2/1981 | Hirose | 194/207 X |
| 5,014,325 | 5/1991 | Moritomo | 356/71 X |
| 5,199,543 | 4/1993 | Kamagami et al. | 194/207 |
| 5,260,582 | 11/1993 | Danek et al. | 356/71 |
| 5,279,403 | 1/1994 | Harbaugh et al. | 194/207 |

FOREIGN PATENT DOCUMENTS

| | | | |
|---|---|---|---|
| 485694 | 5/1992 | European Pat. Off. | 194/207 |

*Primary Examiner*—F. J. Bartuska
*Attorney, Agent, or Firm*—Michael I. Kroll

[57] ABSTRACT

The present invention relates to a counterfeit currency detection system capable of scanning currency on front and back for serial numbers, front and back plate numbers and quadrant numbers. The scanning is digitally computerized and compared to a data bank containing current information on counterfeit currency to determine validity of the present currency.

13 Claims, 3 Drawing Sheets

Fig. 4
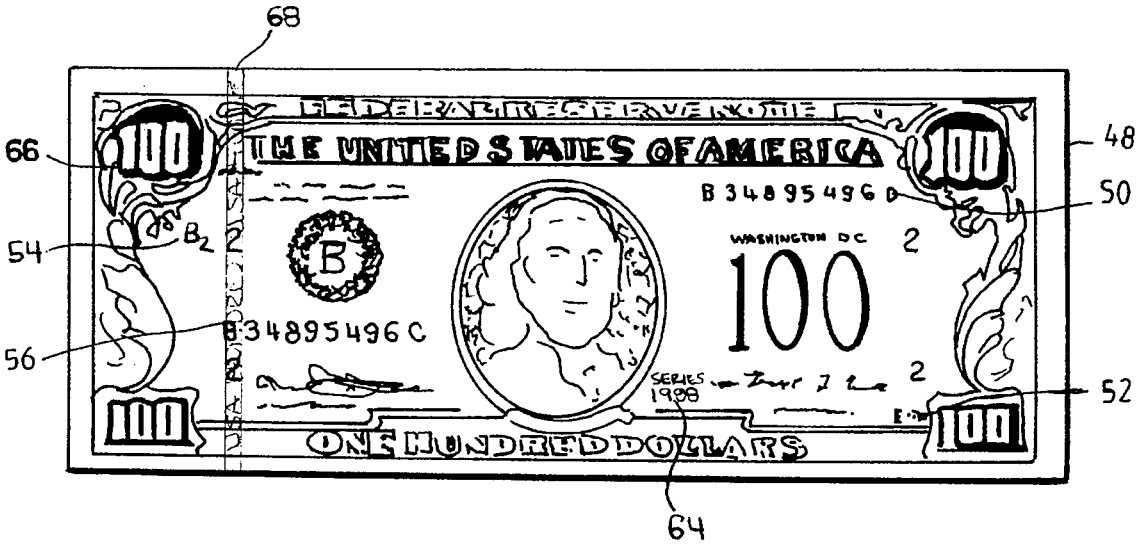
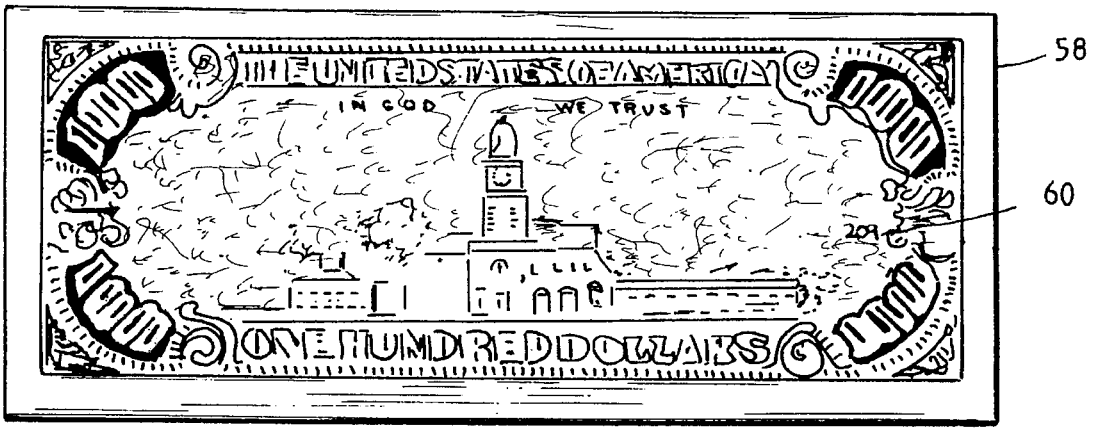
Fig. 5

CURRENCY COUNTER-FEIT DETECTION DEVICE

This application is a continuation of application Ser. No. 08/218,247, filed Mar. 28, 1994, now abandoned.

BACKGROUND OF THE INVENTION

1. Field of the Invention

The present invention relates to optical detection devices and more particularly to a novel optical detection device for use in examining paper currency for genuineness during a high speed handling and counting operation.

This invention relates to a detector of counterfeit currency as contrasted to genuine U.S. paper currency of any denomination.

The present invention is directed to a counterfeit currency detector so as to provide a quick and simple means for detecting counterfeit U.S. paper currency. The invention requires little or no skill to use. The invention may be used to validate paper currency of any origin or country.

2. Description of the Prior Art

The present invention relates to the examination of bills or other currency for purposes such as determining their authenticity and denomination, and more particularly to methods and apparatus for achieving a high level of acceptance of valid bills or currency while simultaneously maintaining a high level of rejection of non-valid bills or currency, such as counterfeits. While the present invention is applicable to testing of bills and other currency, for the sake of simplicity, the exemplary discussion which follows is primarily in terms of paper currency.

The application of the present invention to the testing of paper money, banknotes and other currency will be immediately apparent to one of ordinary skill in the art.

It has long been recognized in the field of bill and currency testing that a balance must be struck between the conflicting goals of "acceptance" and "rejection"—perfect acceptance being the ability to correctly identify and accept all genuine items no matter their condition, and perfect rejection being the ability to correctly discriminate and reject all non-genuine items. When testing under ideal conditions, no difficulty arises when trying to separate ideal or perfect bills from bills or counterfeit bills that have different characteristics even if those differences are relatively slight. Data identifying the characteristics of the ideal bills can be stored and compared with data measured from a bill or bill to be tested. By narrowly defining bill acceptance criteria, valid bills that produce data falling within these criteria can be accepted and bills that produce data falling outside these criteria can be rejected. A well-known method for bill acceptance and bill rejection is the use of bill acceptance windows to define criteria for the bill acceptance. Of course, in reality, neither the test conditions nor the bills to be tested are ideal. Windows or other tests must be set up to accept a range of characteristic bill data for worn or damaged genuine bills, and also to compensate for environmental conditions such as extreme heat, extreme cold, humidity and the like. As the acceptance windows or other bill testing criteria are widened or loosened, it becomes more and more likely that a bill or counterfeit bill will be mistakenly accepted as genuine. As test criteria are narrowed or tightened, it becomes more likely that a genuine bill will be rejected.

Genuine U.S. currency has a magnetic property which is capable of being detected by a magnetic sensor. A hysteresis curve in which magnetization is plotted against magnetizing force of the black ink on a U.S. one dollar bill. The plot is in units of EMU and Oersteds. The plot of the retentivity of black ink on U.S. paper currency is significantly less than the saturation level, indicating that it is preferable to sense the saturation level rather than the retentivity level. This can be accomplished by magnetizing the bill at the sensing location. Previous attempts to accomplish this suffer from the following problems:

1. The magnet tends to saturate the mu-metal shield surrounding the magnetic pick up head, thereby reducing the shielding effectiveness, and
2. The magnet tends to vibrate during machine operation causing an unacceptable magnetic noise source.

In order to solve these problems, the present invention is characterized by comprising a optical head which is utilized as the optical scanning instrument thereby completely eliminating the need for a permanent magnet. In addition, the problems of reduced shielding effectiveness and unacceptable optical noise cannot arise.

The present invention relates to counterfeit detectors for United States paper currency. With modern improvements in copying methods it has become relatively easy for counterfeiters to reproduce paper currency. The production of passable copies no longer requires the work of a skilled engraver. Photographic methods can be used to make accurate plates in a very short time. In addition electrostatic copying equipment has been so perfected that reasonable color copies of legitimate notes can be made easily and rapidly. As a result there has been a steadily growing amount of false currency and an increased cost to merchants and others who must absorb the loss when these copies are passed.

Some methods to detect counterfeit employ special illumination. Because United States bills are printed on rag bond and use no brighteners, they possess characteristic optical properties. Under ordinary light they will have an off-white appearance. Under ultraviolet illumination they will not fluoresce. Papers containing wood pulp and brighteners will not have these properties. A new paper has become available to some counterfeiters however which more closely resembles that used for legitimate notes.

Despite the use of previous optical machines the most effective detection of counterfeit to date has been by highly trained observers who look for small imperfections in the printing.

Prior to the present invention there have existed devices for the detection of counterfeit currency, which devices range in degree of complexity, all of which are requisite of many complicated parts and normally require an operator with considerable skill in order to make proper determinations of the fact of counterfeit currency. Included within the prior art detectors are those which utilize at least partially ultra-violet radiation together with necessary complicating elements.

It has been ascertained through tests and investigations that almost all genuine paper currency made by the U.S. Mint is made from paper which does not include any fluorescent dyes, optical bleaches, or pigments. When genuine paper currency is illuminated by ultraviolet light from approximately 2,500 to approximately 4,000 angstrom units, the currency generally does not exhibit a chromamorphic response other than that naturally attributable to the cotton or linen stock. In recent years, even the U.S. Mint has had difficulty in obtaining rag stock completely free from fibers containing optical bleaches or other fluorescent materials.

Almost all counterfeit currency printed in the past 15 years has been made from rag stock which has a definite chromamorphic response in the blue range when activated by properly filtered ultraviolet light. The present invention does not respond to this descrepency independent of the search of the plate numbers and the invention is predicated thereon.

Occasionally, genuine U.S. paper currency contains isolated fibers which exhibit a chromamorphic response. This is particularly, but not exclusively, true with respect to 10 and 20 dollar bills from the 1963 series. The response exhibited by such currency can be distinguished, with some experience, from counterfeit currency in which the entire unprinted paper surface exhibits a uniform, unbroken fluorescence in blue range, varying in brightness with the amount of optical bleach in the paper stock.

Much counterfeit paper currency, although containing optical bleach, may have a low level of chromamorphic response which is indistinguishable, or nearly so, from legal paper currency, when viewed in an area of high ambient visible light. Besides the fact that on occasion genuine paper currency will exhibit a chromamorphic response which might confuse someone other than a viewer who is well trained or instructed, there are other explanations for possible confusion. For example, genuine currency is often left in wearing apparel which is washed in a bath containing a high amount of optical bleach. Some of the bleach is absorbed by the paper stock and tends to lead one to suspect it as being counterfeit. After viewing tens of thousands of bills in banks, only two such bills have come to our attention. Hence, after considerable experimentation, it has been ascertained that there is another characteristic of genuine paper currency which will facilitate further tests in confirmation of counterfeit currency. It has been ascertained that the black ink used to print the intaglio impression of genuine paper currency has optical characteristics which are detectable and will exhibit the specific reaction to a optical field. It is believed that the incorporation of optical pigment in the black ink has been a specification for genuine paper currency since 1941. The present invention contemplates subjecting any suspected counterfeits to a optical field and the lack of any response will be confirmation that the particular paper currency is counterfeit.

One example of the use of such windows is described in U.S. Pat. Nos. 3,918,564 and 3,918,565, both assigned to the assignee of the present invention. U.K. Application Serial. No. 89/23456.1 filed Oct. 18, 1989, and assigned to the assignee of the present invention, is one response to the real world compromise between achieving adequately high levels of acceptance and rejection at the same time. This U.K. application describes techniques for establishing non-uniform windows that maintain a high level of acceptance while achieving a high level of rejection.

Another prior art approach is found in the Mars Electronics IntelliTrac.™. Series products. The IntelliTrac.™. Series products operate substantially as described in European Patent Application EP 0 155 126, which is assigned to the assignee of the present invention.

Examples of such prior detectors are disclosed in U.S. Pat. No. 2,951,164, and U.S. Pat. No. 2,950,799 both of Timms, and U.S. Pat. No. 3,618,765 to Cooper. With regard to the latter, there is disclosed a viewing window having ultraviolet light bulbs mounted immediately therebeneath with bulbs and the viewing window being above a flat mounting surface available through a port for the insertion of currency to be examined. This particular Cooper apparatus requires that the reflected ultra-violet light be viewed through a window having a filter therein, the filter of necessity having a light blue color thereby permitting the viewing of the light blue or bluish-white chromamorphic response of counterfeit paper currency under the ultra-violet light from the ultraviolet bulbs.

U.S. Pat. No. 3,774,046

COUNTERFEIT CURRENCY DETECTOR

Bernard William Cooper and Jerome Rubler

The apparatus disclosed detects counterfeit U.S. paper currency in a manner which is simple, quick, and requires little or not skill. Almost all official U.S. paper currency does not exhibit a chromamorphic response other than that naturally attributable to the cotton or linen stock. Almost all counterfeit currency will exhibit a definite chromamorphic response in the blue range when activated by properly filtered ultraviolet light. Any suspected counterfeits are further subjected to a test for determining the optical characteristics of the ink. Genuine U.S. paper currency for the last 25 years uses black ink which incorporates a optical pigment.

U.S. Pat. No. 5,167,313

Method and apparatus for improved bill, bill and other currency acceptance and bill or counterfeit rejection Bob M. Dobbins and Jeffrey E. Vaks Methods and validation apparatus for achieving improved acceptance and rejection for bills, bills and other currency items. One aspect includes modifying item acceptance criteria by creating and defining three-dimensional acceptance clusters, the data for which are stored in look-up tables in memory associated with a microprocessor. A second aspect involves fraud prevention by temporarily tightening or readjusting item acceptance criteria when a potential fraud attempt is detected. A third aspect relates to minimizing the effects of counterfeit items such as bills on the self-adjustment process for the item acceptance criteria. A final aspect relates to calculation of a relative value of the acceptance criteria in order to conserve memory space and minimize computation time.

U.S. Pat. No. 4,764,725

Apparatus for detecting counterfeit currency using two coils to produce a saturating optical field David R. Bryce Counterfeit detection apparatus in which the coils of the optical head are utilized to produce a saturating current for the paper currency being examined which is sufficient to bring the optical ink printed upon the paper currency close to the saturation point to greatly facilitate the detection operation.

U.S. Pat. No. 4,187,463

Counterfeit detector for paper currency

Gilbert Kivenson

A detector apparatus for counterfeit paper currency comprising a clamp and torsion pendulum assembly for holding a note to be tested, a moveable optical field source mounted so that it can be brought into contact with the note and then withdrawn, and indicating means for detecting and measuring deflection of the note.

U.S. Pat. No. 3,774,046

COUNTERFEIT CURRENCY DETECTOR

George E. Hoch and Wilbert H. Hirsch

A detector of counterfeit paper currency as opposed to genuine United States currency of any denomination, which includes a box-like enclosure having a small viewing window, having a port for insertion thereinto of the currency, and having a supporting surface therein in the line of sight of the viewing window positioned such to support currency inserted thereinto with a side thereof facing about the line of sight, with a fluorescent ultra-violet light mounted within the enclosure above the line of sight with a protective baffle blocking direct ultra-violet light from the line of sight and the ultra-violet fluorescent bulb being positioned such that light striking the mounting surface at the location at which the currency to be examined would be viewable passing rays to that point in as nearly parallel relationship as possible relative to the line of sight in order to avoid shadows—i.e., in order to avoid portions of the currency being viewable in the line of sight devoid of reflected ultra-violet light, and similarly to reduce the possibility of shadows from the ultra-violet light, the mounting surface being angled away from the line of sight to an extent preferably such that for a flat mounting surface away from the line of sight beyond the line of light to the mounting point where there is defined between the line of light and the removed flat surface an angle greater than 90. degree., whereby at all times any shadows cast by the ultra-violet light are cast in a direction away from the line of sight through the viewing window, the ultra-violet light from a fluorescent tube ultra-violet bulb, which bulb has therein a filter as a part thereof, casts a reflected light on the currency mounted on the mounted surface in the line of sight with the result that counterfeit currency has a significantly and substantially greater lightness in shade and reflectiveness than genuine U.S. paper currency.

Numerous innovations for counterfeit currency detecting devices have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to simple and cost effective methods and apparatus for achieving improved acceptance and rejection. One aspect of this invention relates to improvements in maintaining an acceptably high level of bill acceptance while achieving a much improved level of bill rejection by substantially modifying the configuration of the bill acceptance criteria. A second aspect relates to fraud prevention by temporarily tightening or readjusting the bill acceptance criteria when a potential fraud attempt is detected. A third aspect relates to minimizing the effects of counterfeit bills and bills on the self-adjustment process for a bill acceptance window while automatically adjusting to compensate for changing environmental conditions. A fourth aspect of the present invention relates to conserving memory space and minimizing computation time in a microprocessor-based bill validation system.

The present invention can be applied to a wide range of electronic tests for measuring one or more parameters indicative of the acceptability of a bill, currency or the like. The various aspects of the invention may be employed separately or in conjunction depending upon the desired application.

Broadly the invention includes a structure defining a substantially complete enclosure except for a small optical scaning means and an insertion port for the insertion therethrough of currency bills of various paper denominations to be examined, and there being a supporting surface within the enclosure for supporting the currency in a position such that a side face of the currency is readily scanned through the scanning means, there being within the enclosure a scanning means having a built-in filter and a barrier for obstructing light therefrom from the line of sight through the scanning means and positioned such that light traveling to the mounting surface for currency to be examined is as nearly parallel as possible to the line of scanning through the scanning means in order to reduce the possibility of shadows produced by microscopic projections above the surface of the currency being examined, such shadows being the result of the light, as compared to the angle of the line of scanning not striking areas viewable in the line of scanning. In order to further reduce the possibility of such areas away from the light not receiving light, the mounting surface is in a preferred embodiment angled away from the line of scanning at least to and possibly past a perpendicular to the line of approaching light from the scanning light such that the probability of any shadows resulting from obstructions in the line of the light are not viewable in the line of scanning through the scanning means. The barrier obstructing light radiation from the line of scanning through the scanning means avoids the possibility of injury to the retina of the eye of a viewing person. The closer the source of the light to the currency being examined, the better the contrast between counterfeit currency and genuine currency. In a preferred embodiment, a genuine currency bill such as a dollar bill is mounted within the enclosure on the mounting surface for comparison with serial numbers and other markings of counterfeit currency, the counterfeit currency having a distinct serial and plate numbers as well as much lighter shade and greater reflectiveness than genuine currency. As a matter of further meeting one or more of the objects of the present invention, the enclosure is preferably shaped in a substantially rectangular cuboid shape with the scanning means being located such that the line of scanning angles downwardly at about a 45 degree angle, but this angle being variable by having adjustable legs on the front base of the enclosing structure. Also, preferably for speed of use of the detector and convenience as well, the port for the insertion of the currency to be examined extends preferably in a slit receivable of a hand easily and the slit extending along a front base of the rectangular cuboid box, and preferably also extending backwardly along the side and angled upwardly along the slanted mounting base. Within the enclosure, preferably all surfaces include a blackened coating of some sort or another, or at least a dark-shaded coating, to reduce the reflectiveness of white light from outside of the box through the port and/or through the viewing window.

An important byproduct of the present invention is the education of the public with respect to the nature of counterfeit currency and to help them recognize genuine currency. The present invention may be used by the general public, banking institutions, institutions which lend money or handle large amounts of money, etc. The invention may be supplied with specimens which indicate the reaction to be obtained with genuine currency and the reaction to be obtained with counterfeits. Such specimens may exaggerate the unclear, indistinct and broken lines in counterfeits as well as the lifelike appearance of portraits in genuine paper currency. Often the red and blue threads in the paper of genuine currency are simulated in counterfeits by printing red and blue lines on the paper.

All U.S. paper currency with a series year of 1990 and later (except denominations of $1.00 and $5.00) have a security strip embeded in the paper. The apparatus of the present invention scans the notes to read these strips, the absence of which in notes of 1990 series or later will signify that the note is counterfeit. If the apparatus does not detect the security strip by scanning and the series year is prior to 1990, it will indicate that the note is genuine provided that it meets the criteria for the search of its plate numbers.

It is an object of this invention to provide a simple apparatus whereby persons of limited training will be able to check suspected paper currency.

It is another object of this invention to force would-be counterfeiters to meet new standards in addition those involved with paper quality and printing accuracy, thereby increasing the difficulty of producing passable imitations.

An object of the present invention is to simplify the structure and necessary elements for the detection of any denomination of counterfeit currency as compared to genuine U.S. paper currency.

Another object is to obtain a detector of counterfeit money not requiring special viewing filters.

Another object is to obtain a detector for viewing and detecting counterfeit paper currency in which the eyes of the viewing person are securely protected against the hazards of the blinding radiation.

Another object is to obtain a paper currency counterfeit detector of simple construction and low cost of production.

Another object is to obtain a detector of paper counterfeit currency which is of improved reliability and fool-proof detection of counterfeit currency.

Another object is to obtain a detector of paper counterfeit currency overcoming one or more of the problems of the type discussed above.

Another object is to obtain a paper counterfeit currency detector successfully operable by an amateur.

Another object is to obtain a detector of paper counterfeit currency providing for easy insertion and withdrawal for high speed determinations by either left-handed or right-handed persons.

It is an object of the present invention to provide novel apparatus for detecting counterfeit paper currency and/or confirming the genuineness of U.S. paper currency.

It is another object of the present invention to provide apparatus for detecting counterfeit paper currency in a manner which is simple, quick, and requires little or no experience.

It is another object of the present invention to provide novel apparatus for confirming the genuineness or counterfeit nature of paper currency in response to the presence or absence of a reaction when the currency is subjected to a optical field.

Accordingly, it is an object of the present invention to provide a counterfeit currency detecting device whereby serial numbers, plate numbers and other unique distinguishing features of original currency may be distinguished from counterfeit currency by a simple scanning means which communicates said scanning results to a data bank containing updated information on counterfeit currency to determine genuineness.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

FIG. 4 is a top view of a United States of America currency exhibiting a left quadrant number, serial number in lower left hand corner, serial number in upper right hand corner, and a front plate number.

FIG. 5 is a bottom view of a United States of America currency exhibiting a back plate number.

LIST OF REFERENCE NUMERALS UTILIZED IN THE DRAWING

10—CURRENCY COUNTERFEIT DETECTION DEVICE 11
13 A—FIRST BARRIER
12—RED INDICATOR LIGHT
13 B—SECOND BARRIER
14—YELLOW INDICATOR LIGHT
16—GREEN INDICATOR LIGHT
18—KEYPAD
20—DISPLAY SCREEN
22—HAND
24—CURRENCY
26—TABLE
28—CURRENCY INSERTION SLOT
30—PERSON
32—CURRENCY EXITING SLOT
34—FORWARD RIGHT ROLLER
36—REARWARD RIGHT ROLLER
38—FORWARD LEFT ROLLER
40—REARWARD LEFT ROLLER
42—ROLLER BRACKET
44—ROLLER AXIAL
46—ROLLER BRACKET AXIAL HOLE
48—FRONT OF CURRENCY
50—SERIAL NUMBER IN UPPER RIGHT HAND CORNER
51—BOTTOM OPTICAL SCANNER
52—FRONT PLATE NUMBER
53—TOP OPTICAL SCANNER
54—LEFT QUADRANT NUMBER

55—OPTICAL SCANNER
56—SERIAL NUMBER IN LOWER LEFT HAND CORNER
58—BACK OF CURRENCY
60—BACK PLATE NUMBER
62—FEDERAL RESERVE BANK DISTRICT LETTER
64—SERIES YEAR
66—DENOMINATION OF NOTE
68—SECURITY STRIP EMBEDED INTO PAPER

DETAILED DESCRIPTION OF THE PREFERRED EMBODIMENT

Figure 1:
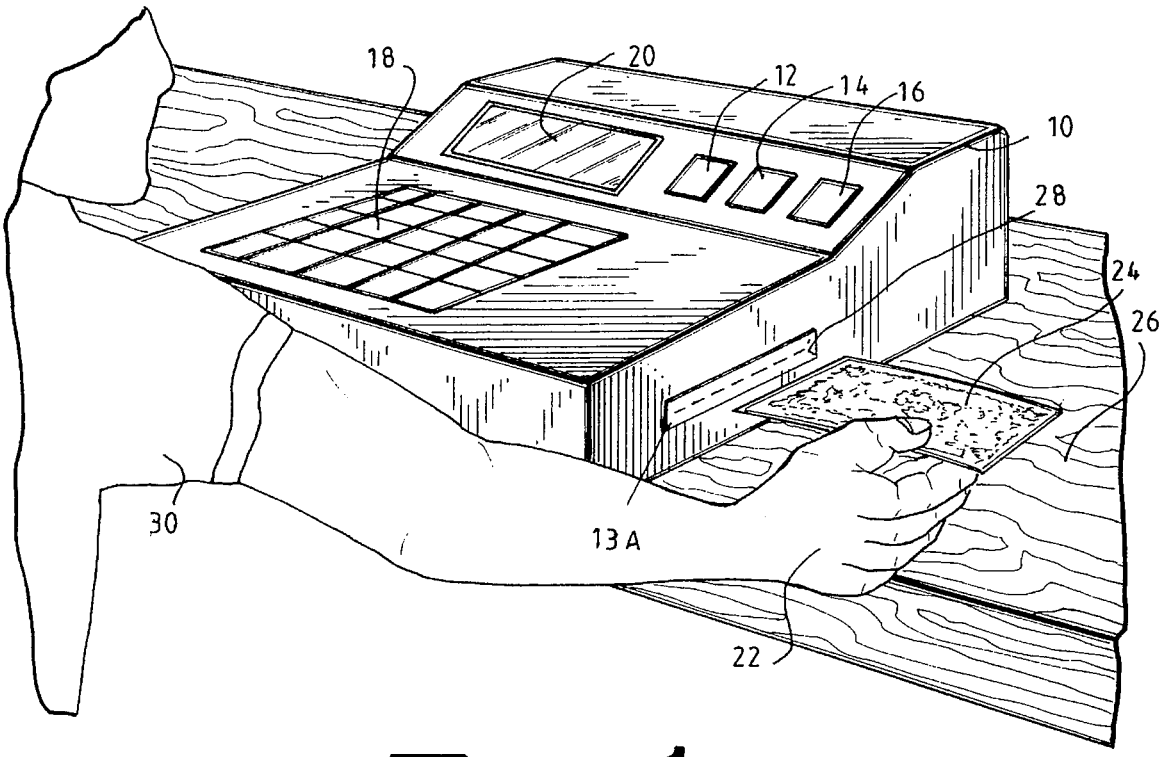
FIG. 1 is a perspective view of a counterfeit currency detection system exhibiting a slot in which suspected currency is inserted, a numeric keypad and indication system lights which notify person of counterfeit currency.

Referring to FIG. 1 is a perspective view of a counterfeit currency detection system 10 exhibiting a currency insertion slot 28 in which suspected currency 24 is inserted by hand 22, a numeric keypad 18 and indication system lights having a red 12, yellow 14, and green 16 indicator lights and a display screen 20 which notify a person 30 of counterfeit currency. The entire counterfeit currency detection system 10 is conveniently mounted upon a table 26. When a person 30 places currency 24 into a counterfeit currency detection system 10, the currency 24 is automatically drawn into the device 10 for optical scanning.

Figure 2:
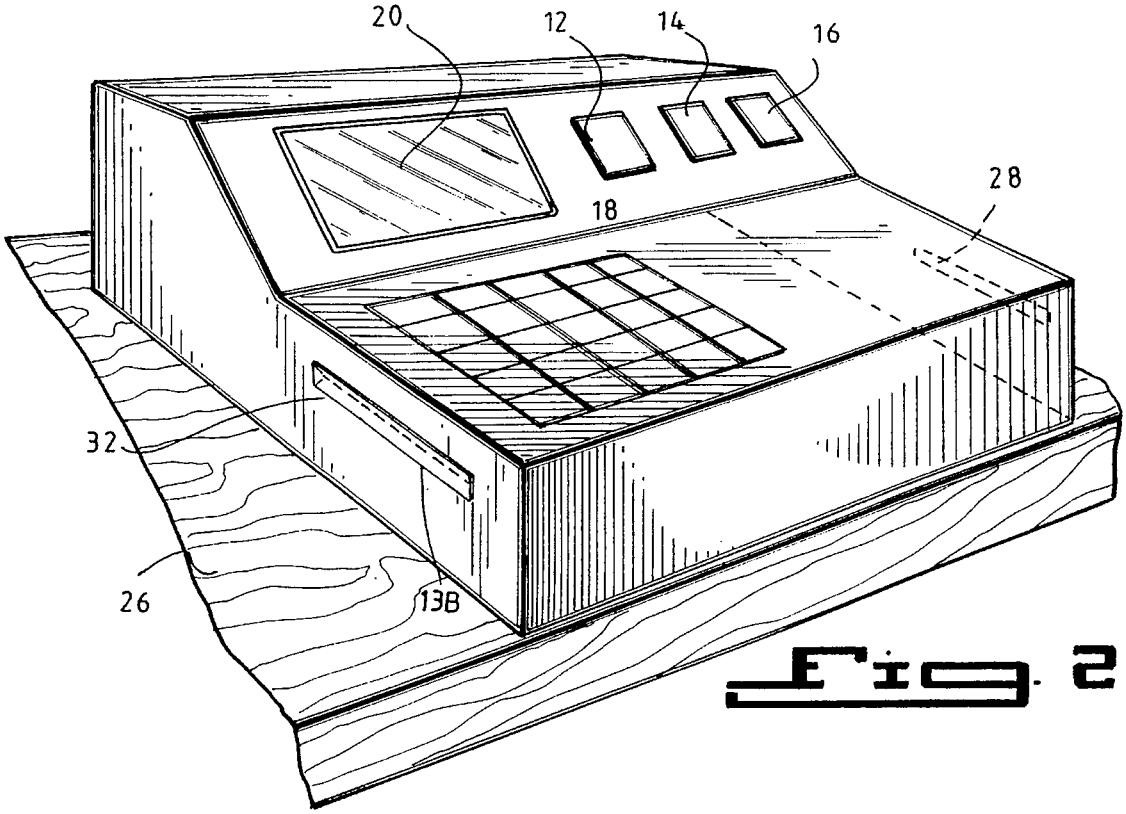
FIG. 2 is a perspective view of a counterfeit currency detection system exhibiting a slot in which suspected currency is inserted with a complimentary slot by which the currency exits, a numeric keypad and indication system lights which notify person of counterfeit currency.

Referring now to FIG. 2 which is a perspective view of a counterfeit currency detection system 10 exhibiting a currency insertion slot 28 in which suspected currency 24 is inserted by hand 22 with a complimentary currency exiting slot 32, a numeric keypad, a numeric keypad 18 having a standard keypad arrangement with numbers 1–0 and corresponding alphabetical letters in groups of three commencing with number 1 which corresponds to a,b,c printed thereon said number 1 pad. In addition, there are indication system lights having a red 12, yellow 14, and green 16 indicator lights, an auxiliary keypad having functional key buttons such as numeric, cancel, clear, keypad and enter contained within said main keypad 18 and a display screen 20 which notify a person 30 of counterfeit currency. The entire counterfeit currency detection system 10 is conveniently mounted upon a table 26. When a person 30 places currency 24 into a counterfeit currency detection system 10, the currency 24 is automatically drawn into the device 10 for optical scanning. An optical filter 11 and a barrier (13A, 13B) for obstructing light from a line of sight through the optical scanning device 55. The optical filter 11 and the barrier (13A, 13B) are positioned so that light traveling to the supporting surface for the currency 24 to be examined is substantially parallel to a line of scanning through the optical scanning device 55 in order to reduce an opportunity for shadows produced by microscopic projections above a surface of the currency 24 being examined.

Figure 3:
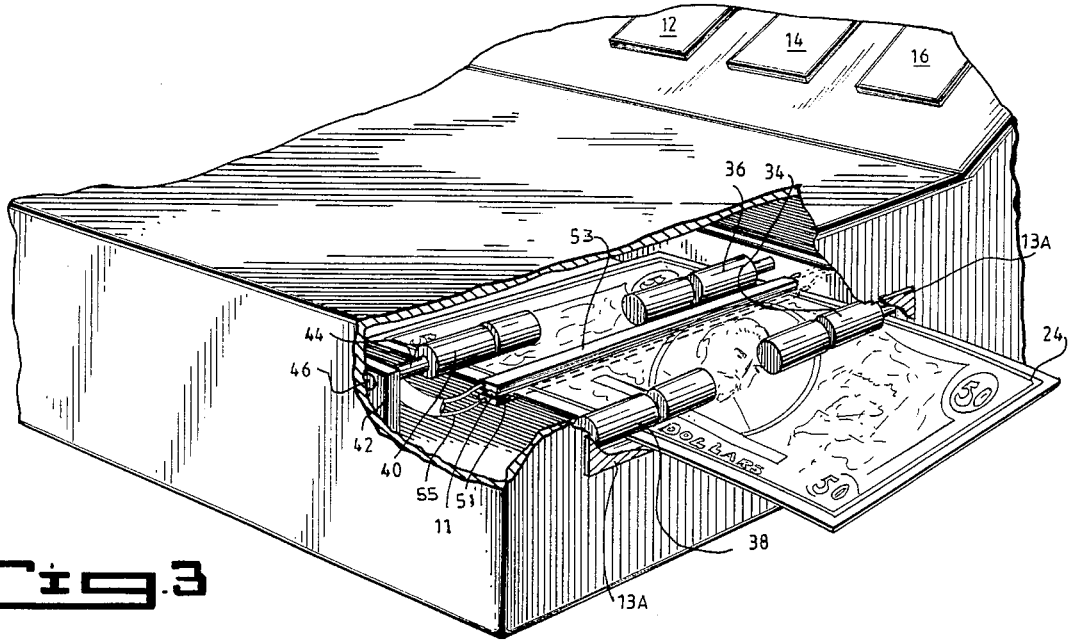
FIG. 3 is a perspective view of a counterfeit currency detection system exhibiting a slot in which suspected currency is inserted, and optical scanning means by which the currency is scanned for counterfeit numbers, and indication system lights which notify person of counterfeit currency.

Referring now to FIG. 3 which is a perspective view of a counterfeit currency detection system 10 exhibiting a currency insertion slot 28 in which suspected currency 24 is inserted, and optical scanning means comprising a set of forward right 34 and left 38 rollers which are mounted on roller axial 44 within a roller axial bracket hole 46 in a roller bracket 42 which function to draw in the currency 24 and move it through the scanning system having a top optical scanner 53 and a bottom optical scanner 51 connected to an optical scanning interpreter by optical scanning cables 55 to a second set of rearward left 40 and right 36 rollers which are mounted on roller axial 44 within a roller axial bracket hole 46 in a roller bracket 42 moving the currency 24 out of the currency exiting slot 32 by which the currency 24 is scanned for counterfeit numbers, and indication system lights 12, 14, and 16 which notify person of counterfeit currency 24.

Now referring to FIG. 4 and 5 which is a top view of a United States of America currency 48 exhibiting a left quadrant number 54, serial number in lower left hand corner 56, serial number in upper right hand corner 50, and a front plate number 52. When the currency 24 is drawn into the counterfeit currency detection system 10, the currency 24 optical scanning means comprising a set of forward right 34 and left 38 rollers which are mounted on roller axial 44 within a roller axial bracket hole 46 in a roller bracket 42 which function to draw in the currency 24 and move it through the scanning system having a top optical scanner 53 functioning to scan left quadrant number 54, serial number in lower left hand corner 56, serial number in upper right hand corner 50, and a front plate number 52 and a bottom optical scanner 51 functioning to scan the back plate number 60 located on the back of currency 58, federal reserve bank district letter 62, series year 64, denomination of note 66, security strip embeded into paper 68 connected to an optical scanning interpreter by optical scanning cables 55 to a second set of rearward left 40 and right 36 rollers which are mounted on roller axial 44 within a roller axial bracket hole 46 in a roller bracket 42 moving the currency 24 out of the currency exiting slot 32 by which the currency 24 is scanned for counterfeit numbers, and indication system lights 12, 14, and 16 which notify person of counterfeit currency 24. The method of optical scanning interpretation includes the following steps singuraly and in combination;

a) a left quadrant number 54, b) a serial number in lower left hand corner 56, c) a serial number in upper right hand corner 50, d) a front plate number 52, e ) a back plate number 60, f) a federal reserve bank district letter 62, g) series year 64, h) denomination of note 66, i) security strip embeded into paper 68, j) scanning said numbers 54, 56, 50, 52, 60, 62, 64, 66, 68 and described herein in comparison to a central data bank containing the latest information on counterfeit currency 24 to determine if the currency 24 is counterfeit, while the scanning is taking place the yellow indicator light 14 is illuminated, k) if currency 24 is valid, the green indicator light 16 is illuminated, l) if currency 24 is counterfeit, the red indicator light 12 is illuminated, and m) displayed thereon the display screen are messages such as "REQUEST IN PROGRESS", "CALL POLICE IMMEDIATELY", "PLEASE INSERT CURRENCY AGAIN FOR SCANNING", and other like messages indicating to the person 30 instructions.

It will be understood that each of the elements described above, or two or more together, may also find a useful application in other types of constructions differing from the type described above.

While the invention has been illustrated and described as embodied in a counterfeit currency detection system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A counterfeit currency detection system, comprising:

a) a housing;

b) at least one currency inlet slot;

c) at least one currency exiting slot;

d) a plurality of rollers directly connected to a mechanical driving means to turn said rollers functioning to draw said currency through said counterfeit currency detection system;

e) a supporting surface within said housing for supporting the currency during a scanning procedure;

f) a plurality of optical scanning devices having at least one optical scanning device located on the bottom functioning to scan the bottom plate number which is located on the bottom of currency and at least one optical scanning device located on the top functioning to scan serial number in upper right hand corner, front plate number, left quadrant number, serial number in lower, and left hand corner located on the top of currency, said optical scanning device including an optical filter and a barrier for obstructing light from a line of sight through said optical scanning device, said optical filter and said barrier being positioned so that light travelling to said supporting surface for said currency to be examined is substantially parallel to a line of scanning through said optical scanning device in order to reduce an opportunity for shadows produced by microscopic projections above a surface of the currency being examined;

g) at least primary one numeric keypad with corresponding alphabets printed thereon numeric key pads;

h) at least one secondary keypad having functional keys such as numeric, cancel, keypad, clear, enter and similar commands;

i) at least one indicator light functioning to visually alert a person scanning said currency if said currency is valid or counterfeit;

j) means comparing the numbers scanned on the currency with numbers in a data bank containing current information about counterfeit currency to determine if the currency being scanned is counterfeit; and k) said housing including indicator lights having at least one yellow indicator light which illuminates while scanning is taking place, at least one green indicator light which illuminates if currency is valid, and at least one red indicator light which illuminates if currency is counterfeit.

2. The counterfeit currency detection system according to claim 1, wherein said supporting surface is angled away from the line of scanning, at least, to a point beyond a perpendicular to a line of approaching light from the scanning light so that the probability of any shadows resulting from obstructions is minimized.

3. The counterfeit currency detection system according to claim 1, wherein said housing has at least one angled side for displaying said visual indicating lights.

4. The counterfeit currency detection system according to claim 1, wherein said currency insertion and exiting slot is constructed for accommodating varying sizes of currency utilized worldwide.

5. The counterfeit currency detection system according to claim 1, whereas said optical scanning device is capable of scanning all sections on top and bottom of said currency to detect said numbers.

6. The counterfeit currency detection system according to claim 5, whereas said optical scanning device is designed specifically to accommodate varying sizes of currency utilized worldwide.

7. The counterfeit currency detection system according to claim 5, whereas said optical scanning device functions to convert said numbers into digitized form functioning to increase speed of character recognition.

8. A counterfeit currency detection system, comprising:

a) a housing;

b) at least one currency inlet slot;

c) at least one currency exiting slot;

d) a plurality of rollers directly connected to a mechanical driving means to turn said rollers functioning to draw said currency through said counterfeit currency detection system;

e) a supporting surface within said housing for supporting the currency during a scanning procedure;

f) a plurality of optical scanning devices having at least one optical scanning device located on the bottom functioning to scan the bottom plate number which is located on the bottom of currency and at least one optical scanning device located on the top functioning to scan serial number in upper right hand corner, front plate number, left quadrant number, serial number in lower, and left hand corner located on the top of currency, said supporting surface is away from the line of scanning, at least, to a point beyond a perpendicular to a line of approaching light from the scanning light so that the probability of any shadows resulting from obstructions is minimized;

g) at least primary one numeric keypad with corresponding alphabets printed thereon numeric key pads;

h) at least one secondary keypad having functional keys such as numeric, cancel, keypad, clear, enter and similar commands;

i) at least one indicator light functioning to visually alert a person scanning said currency if said currency is valid or counterfeit;

j) means comparing the numbers scanned on the currency with numbers in a data bank containing current information about counterfeit currency to determine if the currency being scanned is counterfeit; and k) said housing including indicator lights having at least one yellow indicator light which illuminates while scanning is taking place, at least one green indicator light which illuminates if currency is valid, and at least one red indicator light which illuminates if currency is counterfeit.

9. The counterfeit currency detection system according to claim 8, wherein said housing has at least one angled side for displaying said visual indicating lights.

10. The counterfeit currency detection system according to claim 8, wherein said currency insertion and exiting slot is constructed for accommodating varying sizes of currency utilized worldwide.

11. The counterfeit currency detection system according to claim 8, whereas said optical scanning device is capable of scanning all sections on top and bottom of said currency to detect said numbers.

12. The counterfeit currency detection system according to claim 11, whereas said optical scanning device is designed specifically to accommodate varying sizes of currency utilized worldwide.

13. The counterfeit currency detection system according to claim 11, whereas said optical scanning device functions to convert said numbers into digitized form functioning to increase speed of character recognition.

* * * * *